United States Patent [19]

Hornsby, Jr.

[11] 4,007,936

[45] Feb. 15, 1977

[54] NOVELTY CLOSURE

[75] Inventor: James R. Hornsby, Jr., Orlando, Fla.

[73] Assignee: Funstuf, Inc., Orlando, Fla.

[22] Filed: Apr. 9, 1975

[21] Appl. No.: 566,187

[52] U.S. Cl. ..... 273/115; 229/43

[51] Int. Cl.[2] ..... A63F 7/04

[58] Field of Search ..... 273/109, 112, 113, 115, 273/116, 153 R; 46/11, 193; 229/8, 43, 51 WB

[56] References Cited

UNITED STATES PATENTS

| | | | |
|---|---|---|---|
| 92,850 | 7/1869 | Locke et al. | 229/8 |
| 1,388,265 | 8/1921 | Kehl | 273/115 |
| 1,965,083 | 7/1934 | Nisbet | 273/109 |
| 2,510,237 | 6/1950 | Mahoney | 273/153 R |
| 2,562,013 | 7/1951 | Blod | 46/193 |
| 2,731,751 | 1/1956 | Green | 229/8 |
| 2,792,696 | 5/1957 | Stayart | 46/193 |
| 3,051,341 | 8/1962 | Mead | 46/11 |
| 3,188,040 | 6/1965 | Eichler | 273/113 |
| 3,805,991 | 4/1974 | Cheladze et al. | 229/43 |
| 3,822,030 | 7/1974 | Tanzer | 229/43 |

*Primary Examiner*—Richard J. Apley
*Assistant Examiner*—Harry G. Strappello
*Attorney, Agent, or Firm*—Roylance, Abrams, Berdo & Kaul

[57] ABSTRACT

A novelty closure consists of a container cover, such as that used in connection with soft drink cups, and a puzzle means coupled with said cover at the central portion thereof. The puzzle means takes the form of a planar member having indicia imprinted thereon and having depressions therein and small spherical balls are movably mounted upon the planar member so that by manual manipulation of the cover the balls can be rolled into the depressions.

6 Claims, 4 Drawing Figures

NOVELTY CLOSURE

This invention relates to a novelty type of container closure such as a closure for a soft drink container or the like.

With the advent of fast food and convenience food operations, the use of disposable paper or plastic cup-type containers has become widespread. As a result, it has become common-place to provide a disposable form of container closure or lid which can be applied to the cup or other container to keep the contents thereof from spilling. For the most part, these closures or lids have been formed of thin plastic material and have been provided as disposable items.

In the past, such drink lids or closures have been formed as inexpensively as possible since it has been recognized that they constitute a disposable item which is often used for only a short period of time, such as the interval of time involved in carrying a soft drink from a restaurant to a waiting automobile. On occasion, such closures have been provided with an advertising message or a trademark, either imprinted or embossed thereon, but any advertising value of these closures has been minimized by the fact that they are usually thrown away immediately upon consumption of the drink or other substance which is provided in the container.

It is considered beneficial from an advertising and a public relations standpoint to provide some form of promotional device or premium, the purpose of which is to attract customers to a particular location or to attract customers to a particular brand of product. As an example, soft drink manufacturers have in the past provided premium discs on the inside of soft drink crown caps so that the consumer will purchase that particular brand of soft drink to be able to collect the premium items.

With the foregoing in mind, it is a primary object of the present invention to provide a novelty form of closure which can be used as a promotional device or premium, while at the same time serving its normal function as a drink lid.

Another object of the present invention is to provide a novelty closure which will be enjoyed, appreciated and retained by consumers, thus generating favorable goodwill to the supplier and assuring that the suppliers-'advertising message will be reviewed and retained.

Another object of the present invention is to provide an inexpensive yet enjoyable form of novelty closure which can be provided by a merchant or manufacturer for the purpose of attracting customers to a particular facility or to a particular product.

Other objects, advantages and salient features of the present invention will become apparent from the following detailed description, which, taken in conjunction with the annexed drawings, discloses preferred embodiments thereof.

The foregoing objects are attained by providing the combination of a normal container closure and a puzzle means. In particular, the puzzle means is coupled with the central portion of the container cover so that by manual manipulation of the cover, the puzzle can be played and enjoyed. The puzzle itself takes the form of a flat sheet, disc or other planar member having indicia imprinted thereupon and depressions formed therein. Small spherical balls are movably positioned upon the member so that by manual manipulation of the cover in a proper manner, the balls can be rolled into the depressions.

Referring now to the drawings, which form a part of this original disclosure:

Figure 1:
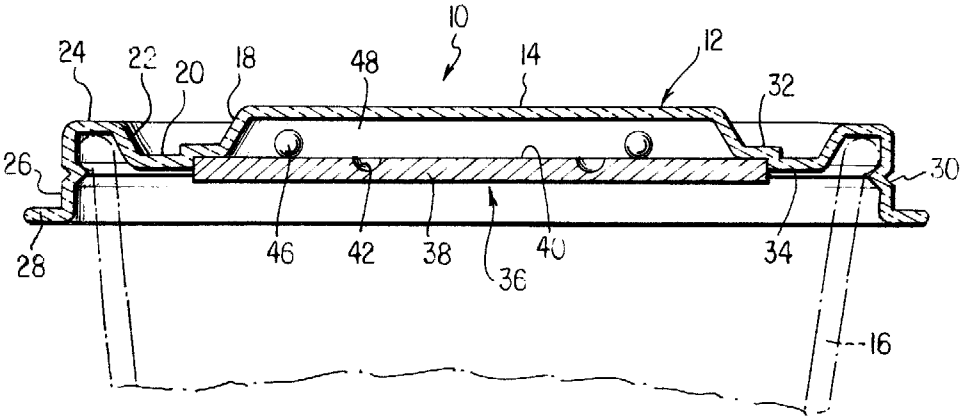
FIG. 1 is a transverse sectional view through a first embodiment of novelty closure in accordance with the principles of the present invention.

Referring now to the drawings in further detail, there is illustrated in FIG. 1 a novelty closure in accordance with the present invention, such novelty closure being generally designated 10. The novelty closure includes a container cover generally designated 12 having a flat central portion 14 provided at the middle thereof. The container cover 12 in the embodiment of FIG. 1 is formed of a transparent material, preferably plastic, and is of the type which can be applied across the top of a conventional open-topped cup or container which is illustrated in phantom line as 16. It will be understood, however, that the container itself forms no part of the present invention.

The construction of the container cover 12 is such that the central portion 14 is a planar section which integrally merges into a depending skirt 18, then merges outwardly into an annular base portion 20. The annular base portion 20, in turn, integrally merges into an upstanding shoulder 22, then into an outwardly extending web 24 and finally into a depending outer skirt 26 which terminates in an outwardly flared flange or lip 28. As such, it can be seen that the portion defined between the shoulder 22, web 24 and outer skirt 26 forms an annular channel into which the upper bead of the container 16 fits. An inwardly directed ridge 30 can be provided along the outer skirt 26 for the purpose of fitting beneath the container bead. As to the annular portion 20, such portion can be formed in a stepped fashion, having a first section 32 extending radially outwardly from the depending skirt 18 and a second somewhat depressed portion 34 connected thereto.

Figure 2:
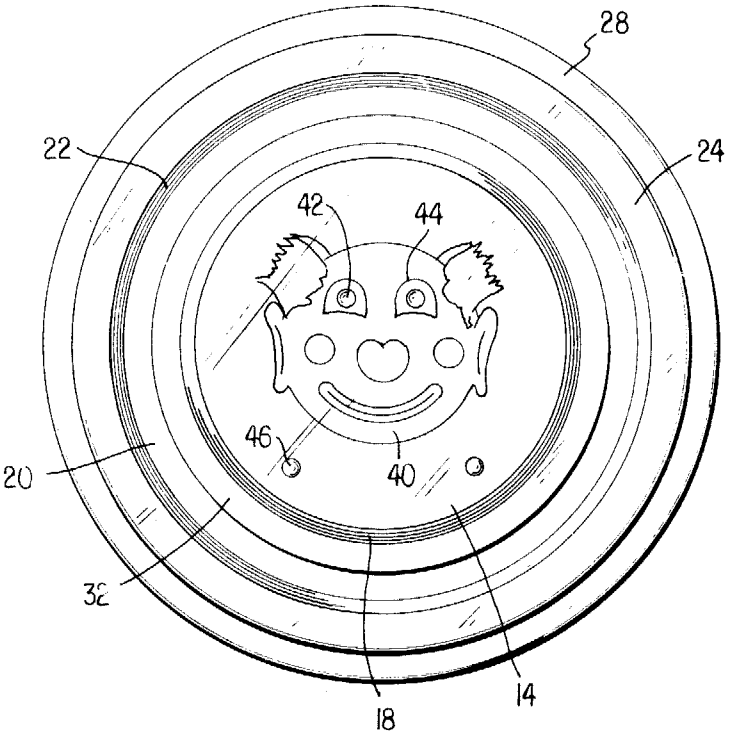
FIG. 2 is a top plan view of the novelty closure of FIG. 1.

The puzzle means in accordance with the present invention is generally designated 36. It includes, in the FIG. 1 embodiment, a planar member in the form of a disc 38, the upper surface of which has indicia 40 imprinted thereupon. The indicia 40 can take the form of a caricature, as shown in FIG. 2, or any other suitable or desirable illustration. Depression means 42 are provided in the disc 38 and while the number of depression means can be varied as desired, it is preferred that at least two such depressions 42 be used. As shown in FIG. 2, if the indicia 40 is in the form of a face, an advantageous positioning of the depressions 42 is within the eyes 44 on the face.

The disc 38 is peripherally attached at its edge to the underside of the annular portion 20 of the container cover 12. Such attachment can be either by adhesive means or by cohesive means, such as by heat sealing the disc 38 to the cover 12.

Suitable ball means in the form of spherical balls 46 are provided as part of the puzzle means 36. The diameter of the balls 46, which can be small bee-bees, is such that the balls 46 will fit into the depressions 42, and additionally, is such as to be less than the distance between the top surface of the disc 38 and the bottom surface of the cover central portion 14. As such, the balls 46 are freely movable and rollable upon and across the disc 38 so that by manual manipulation of the novelty closure 10, one can try to roll the balls 46 into the depressions 42. The balls 46 are prevented from escaping from the puzzle means 36 because they are totally enclosed within a chamber 48 bounded on its top by the central portion 14 of the cover, on the bottom by the disc 38 and at the side edges by the peripheral skirt portion 18. Because the container cover 12 is transparent in the FIG. 1 embodiment, one can easily see through the central portion 14 to observe the indicia 40 and the balls 46 for the purpose of manipulating the balls.

Figure 3:
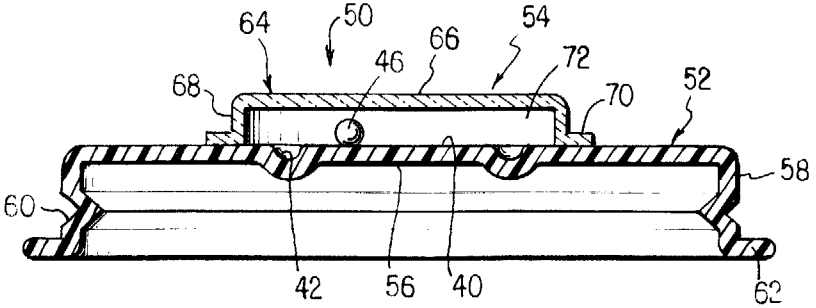
FIG. 3 is a transverse sectional view through another embodiment of novelty in accordance with the present invention.

Turning attention now to FIG. 3, there is disclosed therein an alternate embodiment of the present invention in the form of a novelty closure generally designated 50. The FIG. 3 embodiment includes a container cover generally designated 52 and a puzzle means generally designated 54. The container cover 52 need not be formed of transparent material in the FIG. 3 embodiment, but instead, can be either transparent, translucent or opaque, as desired. The cover 52 includes a central portion 56, upon the upper surface of which the indicia 40 can be imprinted. Likewise, the depressions 42 are formed directly within the central portion 56 in the FIG. 3 embodiment. The container cover 52 additionally includes a depending outer skirt 58 having a groove or notch means 60 formed therein and terminating in an outwardly directed flange or lip 62. It can thus be seen that the depending outer skirt, groove and lip in the FIG. 3 embodiment is similar or identical to that of the FIG. 1 embodiment.

The puzzle means 54 in the FIG. 3 embodiment includes a transparent cap member generally designated 64 and including a top section 66 which can be domed or flat, as desired, a depending skirt 68 extending downwardly from the top 66 and an outwardly directed flange 70 which is used to attach the cap member 64 to the container cover 52. Again, such attachment can be either by adhesive means or by cohesive means. The chamber 72 formed between the top 66 of the cap and the central portion 56 of the cover 52 is again of a height which exceeds the diameter of the balls 46, which balls are freely positioned within the space 72 to be rollable across the central portion 56 and the indicia 40 imprinted thereupon to enable the user to manipulate the balls 46 into the depressions 42.

As can be seen, either of the embodiments can be inexpensively manufactured, yet both embodiments are capable of providing an interesting and enjoyable puzzle which can be manipulated by children or adults alike to provide an interesting novelty item. If desired, an advertising message can form a part of the printed indicia, or alternatively, the indicia itself can be in the form of a trademark so that even as the puzzle is operated, the advertising message is being transmitted. Thus, soft drink manufacturers, fast food restaurants, ball parks or other similar merchants or manufacturers could use novelty closures such as those described herein for premiums or promotional items which would be given away to the purchaser of a drink.

Figure 4:
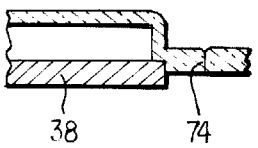
FIG. 4 is a fragmentary sectional view showing a modification which can be used in connection with either of the disclosed embodiments.

Finally, referring to FIG. 4, it is shown therein that suitable scoring or score lines 74 can be provided along the container cover in surrounding relationship to the puzzle means thereon. Thus, by manually rupturing the unit along the scoring lines 74, one can remove the puzzle means to retain the same for future use while at the same time being able to discard the outer rim portion of the closure.

Various changes and modifications apparent to those skilled in the art can be made to the invention described herein without departing from the spirit and scope of such invention as defined in the appended claims.

What is claimed is:

1. A novelty closure comprising:

a container cover having a central portion, and puzzle means coupled with said cover at said central portion, said puzzle means comprising a planar member having indicia thereon and having depression means therein, and ball means movably disposed upon said planar member, said puzzle means being operative by manual manipulation of said container cover to position said ball means in said depression means, said container cover being scored in surrounding relation to said central portion to enable said central portion and said puzzle means to be removed from the remainder of said cover by manual rupturing along said scoring.

2. A novelty closure comprising:

a container cover having a central portion, and puzzle means coupled with said cover at said central portion, said puzzle means comprising a planar member having indicia thereon and having depression means therein, and ball means movably disposed upon said planar member, said puzzle means being operative by manual manipulation of said container cover to position said ball means in said depression means;

said container cover further including a container engaging portion formed integrally with said central portion;

said container engaging portion including an outer portion surrounding said central portion and a skirt depending from said outer portion and terminating at a lower edge disposed beneath said planar member;

said outer portion being engageable upon, and said skirt extending along the outside of, a container closable by said container cover;

said puzzle means further comprising a transparent upper portion superposed in spaced relation above said planar member and a peripheral skirt portion extending between said planar member and said upper portion to thus retain said ball means upon said planar member;

said ball means being spherical balls and the distance between said upper portion and said planar member exceeding the diameter of said spherical balls to assure that said balls are freely movable upon and across said planar member;

said puzzle means planar member comprising a disc having indicia imprinted thereon and having depression means formed therein, said disc being attached to the underside of said container cover whereby said central portion of said cover forms said upper portion;

said disc having the periphery thereof attached to said container cover adjacent the bottom of said peripheral skirt.

3. A novelty closure as defined in claim 2 wherein said skirt is provided with an inwardly directed ridge to facilitate securing of said cover to a container.

4. A novelty closure comprising:

a container cover having a central portion, and puzzle means coupled with said cover at said central portion, said puzzle means comprising a planar member having indicia thereon and having a depression means therein, and ball means movably disposed upon said planar member, said puzzle means being operative by manual manipulation of said container cover to position said ball means in said depression means;

said container cover further including a container engaging portion formed integrally with said central portion;

said container engaging portion including an outer portion surrounding said central portion and a skirt depending from said outer portion and terminating at a lower edge disposed beneath said planar member;

said outer portion being engageable upon, and said skirt extending along the outside of, a container closable by said container cover;

said puzzle means further comprising a transparent upper portion superposed in spaced relation above said planar member and a peripheral skirt portion extending between said planar member and said upper portion to thus retain said ball means upon said planar member;

said ball means being spherical balls and the distance between said upper portion and said planar member exceeding the diameter of said spherical balls to assure that said balls are freely movable upon and across said planar member;

said central portion of said cover has said indicia imprinted thereon and has said depression means formed therein whereby said cover central portion comprises said puzzle means planar member and wherein said closure further includes a cap member positioned upon and attached to said central portion, said cap member having a transparent top wall which forms said upper portion;

said container cover central portion and outer portion having top surfaces lying in the same plane.

5. A novelty closure as defined in claim 4 wherein said skirt is provided with an inwardly directed ridge to facilitate securing of said cover to a container.

6. A novelty closure comprising:

a container cover having a central portion, and puzzle means coupled with said cover at said central portion, said puzzle means comprising a planar member having indicia thereon and having depression means therein, and ball means movably disposed upon said planar member, said puzzle means being operative by manual manipulation of said container cover to position said ball means in said depression means;

said puzzle means further comprising a transparent upper portion superposed in spaced relation above said planar member and a peripheral skirt portion extending between said planar member and said upper portion to thus retain said ball means upon said planar member;

said ball means being spherical balls and the distance between said upper portion and said planar member exceeding the diameter of said spherical balls to assure that said balls are freely movable upon and across said planar member;

said central portion of said cover having said indicia imprinted thereon and having said depression means formed therein whereby said cover central portion comprises said puzzle means planar member, said closure further including a transparent cap member having a top which comprises said puzzle means upper portion and having a depending skirt which comprises said puzzle means peripheral skirt portion;

said cap member further including a flange extending outwardly from said depending skirt, said flange being attached to said cover to couple said cap member to said cover.

* * * * *